US005230103A

United States Patent [19]

Antunez

[11] Patent Number: 5,230,103

[45] Date of Patent: Jul. 27, 1993

[54] SHORT CYCLE FLUSH VALVE FOR COMMODE TANKS

[76] Inventor: Bruce A. Antunez, 1143 Indian Springs, Glendora, Calif. 91740

[21] Appl. No.: 730,235

[22] Filed: Jul. 15, 1991

[51] Int. Cl.[5] ..... E03D 1/35

[52] U.S. Cl. ..... 4/404; 4/393

[58] Field of Search ..... 4/393, 394, 395, 396, 4/397, 400, 403, 404, 324, 378, 392, 415

[56] References Cited

U.S. PATENT DOCUMENTS

| | | | |
|---|---|---|---|
| 2,767,406 | 10/1956 | Bennett | 4/392 |
| 2,835,900 | 5/1958 | Gleason | 4/324 |
| 3,040,334 | 6/1962 | Corsaw | 4/400 |
| 3,590,395 | 7/1971 | Wustner . | |
| 3,935,598 | 2/1976 | Schmidt | 4/393 |
| 3,955,218 | 5/1976 | Ramsey . | |
| 4,000,526 | 1/1977 | Biels et al. . | |
| 4,189,795 | 2/1980 | Conti et al. | 4/324 |
| 4,497,076 | 2/1985 | Sullivan | 4/392 |

FOREIGN PATENT DOCUMENTS

| | | | |
|---|---|---|---|
| 0397552 | 2/1966 | Switzerland | 4/391 |

*Primary Examiner*—William A. Cuchlinski, Jr.
*Assistant Examiner*—W. Morris Worth
*Attorney, Agent, or Firm*—Donald D. Mon

[57] ABSTRACT

A commode flush valve for providing short and adjustable flush cycles. The flush valve includes a valve seat around the upper end of a discharge pipe for a tank, and a body pivoted to it. The body has a peripheral valve seal to bear against the valve seat to close the flush valve. A cup beneath the valve seal has a perforation near its top for exit of air, and an opening at its bottom to enable water to flow therethrough. A removable insert is fitted in this opening with an orifice sized to regulate the rate of flow water therethrough, and perforations to enable substantially all water to drain from the cup where the valve seal rests on the valve seat.

1 Claim, 2 Drawing Sheets

SHORT CYCLE FLUSH VALVE FOR COMMODE TANKS

FIELD OF THE INVENTION

This invention relates to flush valves for commode tanks, and in particular to a valve providing for a short refill cycle.

BACKGROUND OF THE INVENTION

Commode (toilet) flush valves are customarily installed in the bottom of toilet tanks. When opened they permit the outflow of stored water to the commode, and when the tank is emptied they close so as to enable water to be stored for the next flush cycle. During the time the water in the tank is below some storage level, a tank valve is open so as to refill the tank. Of course it also adds the outflow water while the flush valve remains open.

The tank valve is sensitive to the level of the water in the tank. It is open when the water is below some selected storage level, and hopefully will be closed when the water is at or above that level. Customarily some float-type device is responsive to the water level, and opens or closes the tank valve.

The problems of water availability and of sewage water disposal have become very severe, and municipalities are requiring that newly-installed flush toilets operate on very small volumes of water per flush. Even without these constraints, there are substantial incentives to use short flush cycles in existing toilets because of increasing cost of water, and in many areas of decreasing allotments of water per meter served.

Many solutions have been proposed to decrease the volume of water discharged per cycle. Perhaps the most familiar is a brick or partition placed in the tank to reduce the stored volume. This will reduce the volume discharged per cycle without changing the levels in the tank at which the tank valve opens and closes. As a corollary, this means that the exit pressure of the water, each flush, goes from maximum at the start to minimum at the finish. Also this means that the rate of flow diminishes, which is not helpful to a good flush.

This is a time-honored "fix", but one ought to do better. For example, a faster flow rate could be available if flow only occurred between two upper elevations, well above the exit port.

Such a solution is not possible with conventional flush valves because of their configuration. The conventional flush valve is a downwardly-open cup which, when the valve is closed opens directly into the outlet pipe from the tank below the valve seal. Thus, its cavity is drained and renders the float buoyant when the flapper of which it forms a part is lifted. It floats above the valve seal at all times when the valve is open, because it is buoyant as the consequence of the air which it retains. When the tank runs out of water, the valve reseals, and pressure of the stored water keeps the valve closed until it is physically lifted again to start a new cycle.

Thus, the length of the cycle is whatever time it takes to empty the tank, because the float part will remain buoyant until all of the water in the tank is discharged. If variability of discharge volume, and speed of discharge are of little interest, this is a satisfactory system, and certainly it is in very widespread usage. However, water usage has become so critical that in many areas the conventional system is not acceptable.

The problems to be solved by any replacement are (1) to be fitted into existing systems, (2) to discharge a reduced volume of water quickly, and (3) to discharge an accurate amount of water in a consistent period of time. It is an object of this invention to provide a flush valve which solves these problems, which can be adapted for various rates and flows of discharges, and which is simple and inexpensive.

There does exist a flush valve with the above objectives: Angelo J. Conti U.S. Pat. No. 4,189,795. This flush valve has an adjustable orifice into the bottom of its cavity, and a bleed port at its upper end which allows the air to bleed from the cavity when the float has been lifted. Then it gradually loses its buoyancy, and closes the flush valve, even while there still is water in the tank.

This invention uses the same basic scheme in order for the float to lose its buoyancy sooner, thereby to shorten the flush time and discharge. It is also intended to correct some deficiencies in the Conti valve.

The repetitiveness and timing of the flush are heavily dependent on the consistency of the float's buoyancy. For example, any water retained in the float while the valve is seated will change the buoyancy and the time it takes for the float to lose its buoyancy. The Conti patent valve has a latent volume that may not drain. Also it is quite complicated and is more expensive to make than it should be. Toilet valves are intensely competitive, and a few cents more of cost can lose sales.

A flush valve according to this invention drains quickly and consistently. Its orifice is readily exchanged for one of another size, and its operation is independent of the depth of water in the tank, another advantage.

BRIEF DESCRIPTION OF THE INVENTION

A flush valve according to this invention has a body with a valve seat in fluid communication with a discharge pipe that leads to a commode. A conventional standpipe can be included, discharging into the pipe below the seat.

A float is pivotally mounted to the valve seat. It includes a valve seal to bear against the valve seat to close the valve. It can be physically lifted off of the valve seat to open the flush valve.

An inverted cup having a lower opening is fixed to the valve seal so its lower opening is below the valve seat when the valve is closed. An upper bleed port is formed through the wall of the cup above the lower opening, but still below the valve seat when the flush valve is closed. Accordingly, the cap will be drained and filled with air when the flush valve is closed. When the flush valve is first opened, it will render the float buoyant, and it will remain buoyant until sufficient air has been replaced by water in the tank to cause the float to lose its buoyancy, and then it will fall to close the flush valve.

According to this invention the lower opening includes a removable orifice member with an orifice. The orifice can be selected to enable a range of time rates, merely by snapping out one inexpensive orifice member, and substituting another which has a differently sized orifice.

According to yet another feature of this invention, the insert is perforated to enable substantially all of the water in the cup to drain out, thereby eliminating any variability or uncertainty in the buoyancy of the float at the start of the next cycle.

The above and other features of this invention will be fully understood from the following detailed description and the accompanying drawings, in which:

DETAILED DESCRIPTION OF THE INVENTION

Figure 1:
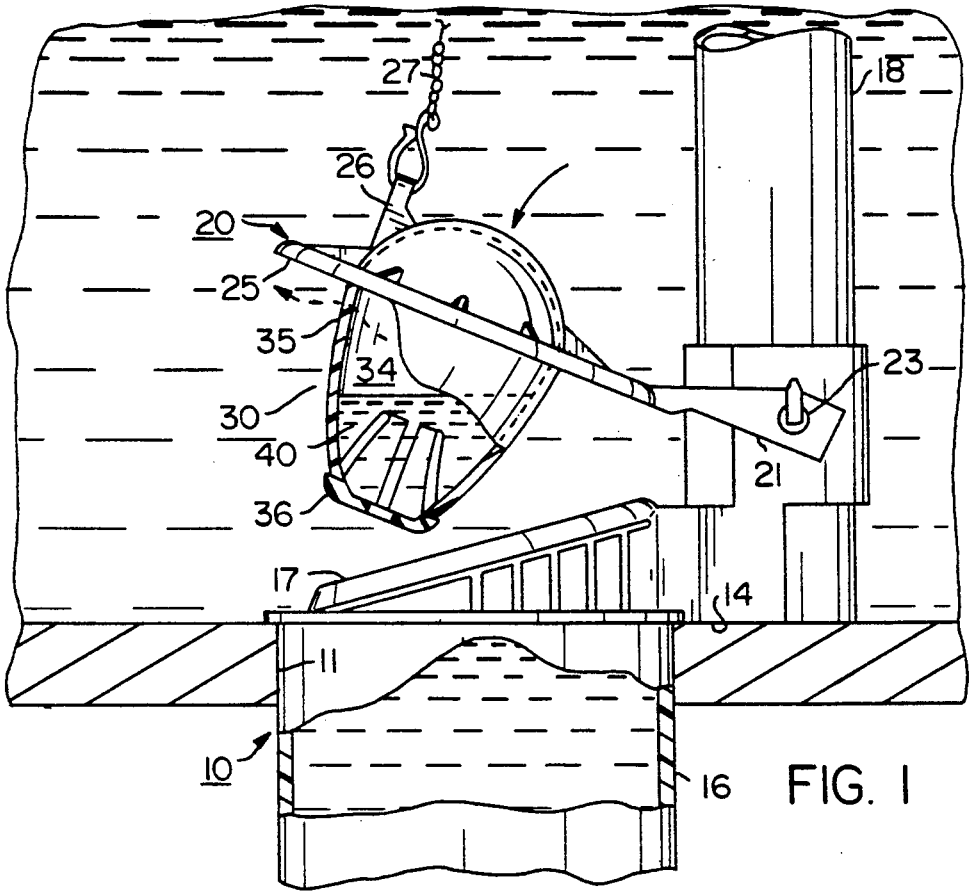
FIG. 1 is a side elevation, partly in cutaway cross-section, showing the valve in its discharging condition.
Figure 2:
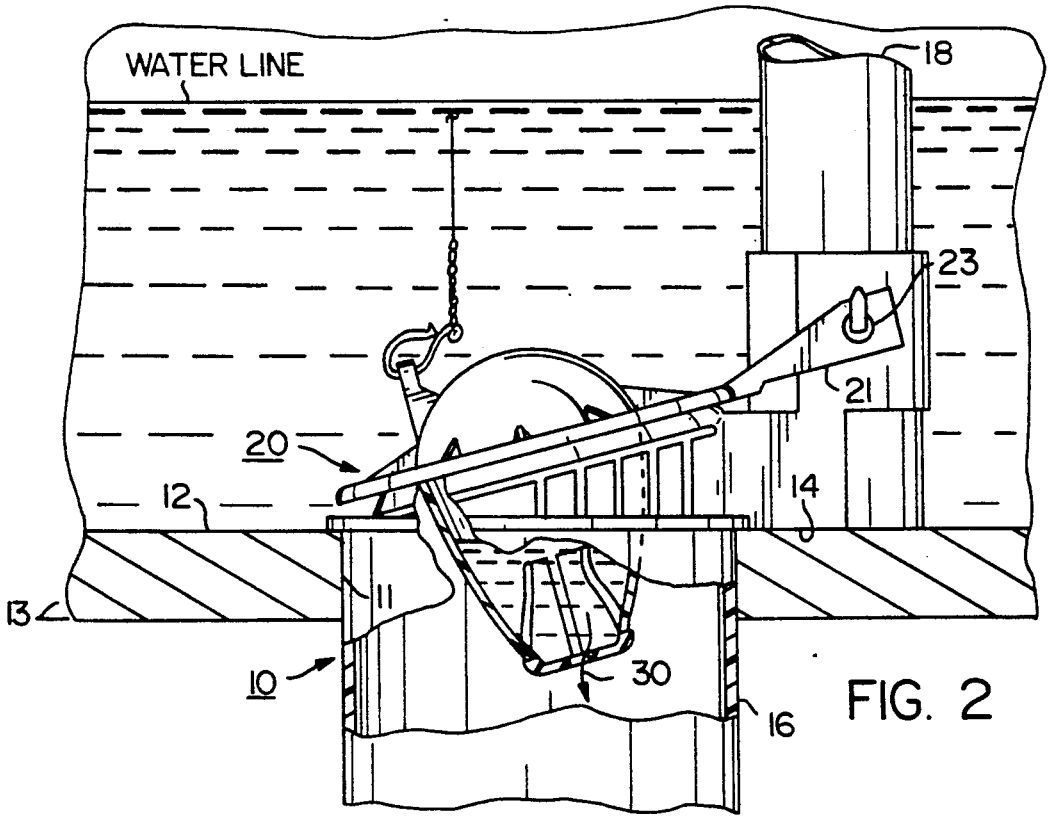
FIG. 2 is a view similar to FIG. 1, in which the valve is shown shortly after having closed.
Figure 3:
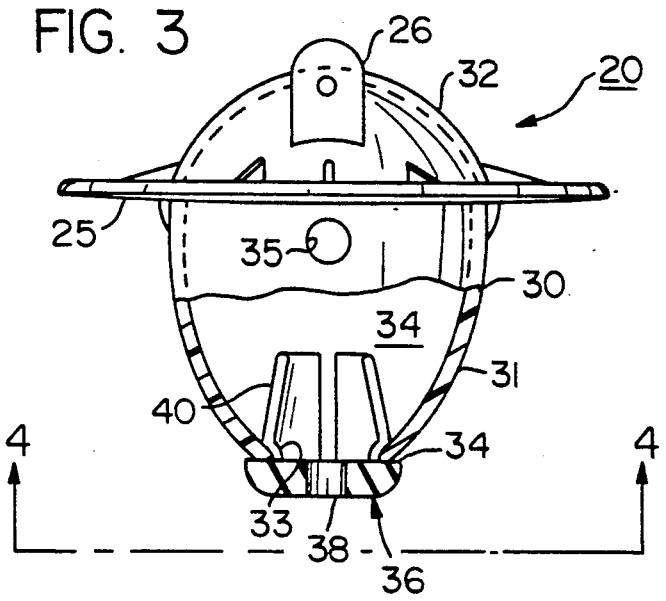
FIG. 3 is a side elevation, partly in a cutaway cross-section of a float portion of FIG. 1.
Figure 4:
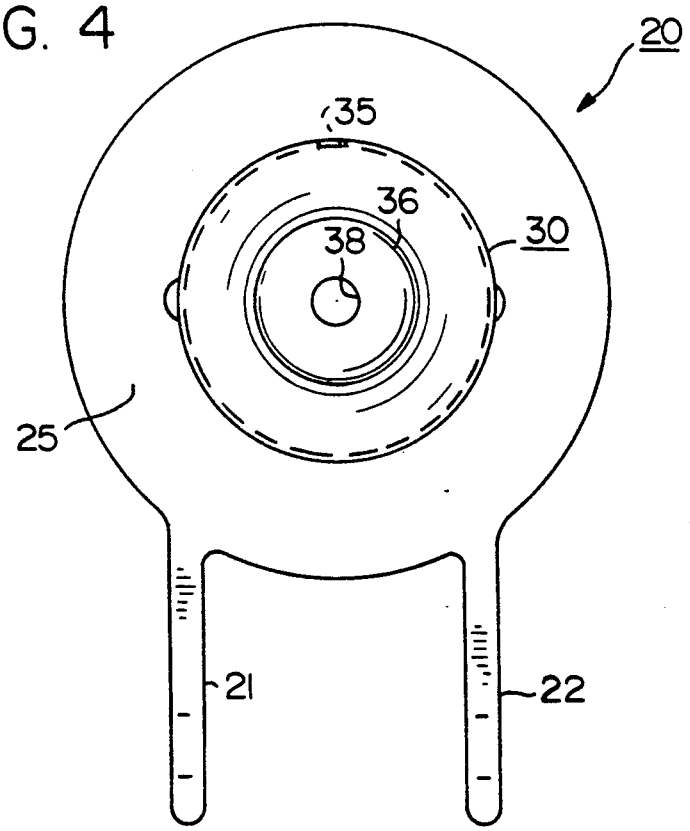
FIG. 4 is a bottom view of FIG. 3, taken at line 4—4 in FIG. 3.

A flush valve 10 according to this invention is shown in FIGS. 1 and 2. It is fitted in an opening 11 in the bottom 12 of a tank 13. A body 14 is fixed to the tank by suitable leak-proof means not shown.

A discharge pipe 16 extends downwardly and discharges into the commode. A valve seat 17 surrounds the upper end of pipe 26. Except when the valve is open and water is flowing, pipe 16 is empty of water and is filled with air.

A standpipe 18 rises from the body to establish an upper overflow limit for water in the tank. It discharges into pipe 16.

Valving member 20 is pivotally mounted by arms 21, 22 to ears 23 on the body. A flat disc-shaped valve seal 25 extends around the periphery of member 20, and is adapted to bear against valve seat 17 to close the valve.

A tab 26 is engaged by a lift chain 27 to lift the valve member (sometimes called a "flapper") off the seat to open the valve to flow.

A float 30 in the form of an inverted cup is integral with valve seal 25 at its center. It has a peripheral wall 31, an imperforate top 32, and an opening 33 at its bottom edge. This forms a cavity 34 which drains when the valve is closed, and which gives buoyancy to the flapper when the valve seal is lifted off of the valve seat and rises into water in the tank. Despite its buoyancy, the flapper will be held down and closed unless lifted, because of the hydrostatic pressure on it, opposed only by the atmospheric pressure in the lesser area of the seal. This is conventional practice.

What is not conventional is bleed port 35 through wall 31 near the top of the cup, and the orifice member 36 in opening 33. Bleed port 35 is below the valve seal, and is of no importance while the valve is closed.

However, when the valving member is lifted, bleed port 35 constitutes a path for exit of air from the float. Its size is not especially important, because it is easier to control the inflow of water into the cup than to control outflow of air from it.

In order to regulate the rate of inflow of water, orifice member 36 is fitted in opening 33. Orifice member 36 has a sized orifice 38 through it. It snugly fits in the opening, and is readily removed and replaced by another orifice member having a differently-sized orifice if desired. By this means the rate at which water can flow into the float can be selectively established.

In order to enable the use of various sizes of orifice, a member with a sufficient diameter to accommodate the largest size must be provided. In turn, this requires a substantial opening 33 which is in a float that is usually a flexible elastometer. In order to be both readily installed and removed, and to be reliably retained, orifice member 33 is made rigid, and is provided with a neck 37 that has a peripheral retention groove in which the edge of the opening 33 fits. Orifice members of one gross size can be supplied with various orifice sizes.

This good solution to the substitution of orifice sizes leads to the problem that the neck can retain water in the cup, which retained water can affect the accuracy of the time period during which the valve is open, and so the amount of water delivered can vary. This is particularly troublesome when determining the size of orifice which is required. On the first test flush, the cup is completely dry, but the next flush will take a different length of time because it starts with some water already in it. When any water is retained, the timing can vary. The cure for this is to be certain that the cup is fully emptied each cycle.

This is accomplished by slots 40 which extend through the wall of the insert, in the neck, through which the water can flow to the orifice. There is no water trapped between the neck and the bottom of the cup.

Accordingly, a rigid orifice member which can have any of a number of orifice sizes can be removed, replaced and reliably held, without risking retention of water by the orifice member itself. Repeatability is assured for every cycle, including the first cycle.

As the air leaves the cup and water enters it, the float loses its buoyancy, and the flapper can close, even while it is still under water. Thus, this tank valve can operate with water at any level in the tank, and is not dependent on total drainage of the tank for it to be closed. Accordingly, the storage level in the tank can not only be set at a higher level and produce a stronger stream, but is not sensitive to malfunctions of the tank valve. It will work at any level, and will give good repeatable water discharges within surprisingly consistent time limits. Notice in the drawings that the float never reaches the surface of the water. Of course it could if the tank level were sufficiently low, but it is an advantage of this device that it works to delever a constant volume regardless of the depth of water in the tank. Any latent volume of water is greatly reduced, and preferably does not exist at all.

With the use of this flush valve, the period between opening and closing of the valve, within a wide range of storage levels, is constant to within about 5%, and a strong flush is always produced. This is a remarkable improvement from a construction this simple.

FIG. 1 shows the valving member during the flush cycle. The cavity has started to lose air and to refill with water. The flapper is on its way down because it is losing its buoyancy.

In FIG. 2, the valving member has just re-seated. The water is draining from the cup, and the flush valve will await its next cycle. Notice that it was never necessary to drain the tank.

If a different volume or time of fluid discharge is desired, it is only necessary to replace the existing orifice member with one which has a larger or smaller orifice depending on whether water is to enter the cup faster or slower. If faster, the cycle will be shorter.

This invention provides a simple and surprisingly accurate means to give a short flush, without modifying the rest of the system. It is readily adjustable, and inexpensive.

This invention is not to be limited to the embodiment shown in the drawings and described in the description which is given by way of example and not of limitation but only in accordance with the scope of the appended claims.

I claim:

1. In a flush valve for a water storage tank, said tank having an opening through its bottom from which a predetermined volume of water is intended to be discharged to a commode as the consequence of the opening and the re-closing of said flush valve, said flush valve comprising a body including a valve seat with a discharge pipe leading from it, and a valving member having a valve seal adapted to bear against said valve seat to close it, and to be lifted off of it to open the flush valve to flow, said valving member including an inverted cup extending within and beneath the valve seat when the valve seal bears against the valve seat to close the flush valve and having a flexible wall forming a cavity, said wall having a bleed orifice beneath and near the valve seal, and also an opening at its lower end, said opening having a boundary edge, the improvement comprising:

a removable rigid tubular insert in said opening, said insert having an enlarged end portion with an orifice therethrough of a size selected to control the rate of entry of water into said cavity to a desired rate, said insert including a neck portion with a peripheral groove adjacent to said enlarged end portion, said boundary edge fitting resiliently in said peripheral groove releasably to hold the insert to the cup with the neck portion extending inside the cup, and a plurality of longitudinal slots through said neck portion extending from a free end of said insert to said groove to enable water to fully drain from the cup to the orifice.

* * * * *